US009611998B2

(12) United States Patent
Bauer et al.

(10) Patent No.: US 9,611,998 B2
(45) Date of Patent: Apr. 4, 2017

(54) LIGHT MODULE FOR A VEHICLE HEADLAMP

(71) Applicant: ZIZALA LICHTSYSTEME GMBH, Wieselburg (AT)

(72) Inventors: Friedrich Bauer, Bergland (AT); Peter Illmayr, St. Poelten (AT)

(73) Assignee: ZKW GROUP GMBH, Wieselburg An Der Erlauf (AT)

( * ) Notice: Subject to any disclaimer, the term of this patent is extended or adjusted under 35 U.S.C. 154(b) by 155 days.

(21) Appl. No.: 14/651,301

(22) PCT Filed: Oct. 22, 2013

(86) PCT No.: PCT/AT2013/050204

§ 371 (c)(1),
(2) Date: Aug. 25, 2015

(87) PCT Pub. No.: WO2014/089585

PCT Pub. Date: Jun. 19, 2014

(65) Prior Publication Data

US 2015/0354773 A1 Dec. 10, 2015

(30) Foreign Application Priority Data

Dec. 13, 2012 (AT) ..... A 50585/2012

(51) Int. Cl.
*F21S 8/10* (2006.01)

(52) U.S. Cl.
CPC ..... *F21S 48/1388* (2013.01); *F21S 48/115* (2013.01); *F21S 48/1317* (2013.01); *F21S 48/1747* (2013.01)

(58) Field of Classification Search
CPC ... F21S 48/115; F21S 48/1747; F21S 48/1388
See application file for complete search history.

(56) References Cited

U.S. PATENT DOCUMENTS 7,311,430 B2 * 12/2007 Tsukamoto ..... F21S 48/1159 362/517
2008/0225540 A1 * 9/2008 Tsukamoto ..... F21S 48/1159 362/514

(Continued)

*Primary Examiner* — Elmito Breval
(74) *Attorney, Agent, or Firm* — Eversheds Sutherland (US) LLP

(57) ABSTRACT

The invention relates to a light module (100) for a motor vehicle headlight, wherein the light module (100) is configured to generate a dimmed light distribution (LV) which has at least one horizontal LD line (HD) and an LD line (HD') ascending diagonally with respect thereto, and wherein the light module (100) comprises at least two reflectors (1, 2, 3), and wherein each reflector (1, 2, 3) is associated with at least one LED light source (10, 20, 30). At least one of the reflectors (2) is of the LD front-field reflector type, and at least one further reflector (1) is of the asymmetric reflector type. The at least one LED light source (10) associated with the least one reflector (1) of the asymmetric reflector type and the at least one LED light source (20) associated with the at least one reflector (2) of the LD front-field reflector type are arranged in a manner fixed relative to one another, and all reflectors (1, 2) can be arranged in exactly one defined position with respect to the LED light sources (10, 20) associated therewith. Reflectors (1) of the asymmetric reflector type and reflectors (2) of the LD front-field reflector type are configured in such a way that, with arrangement of at least one reflector (1) of the asymmetric reflector type in the defined position thereof and at least one reflector (2) of the LD front-field reflector type in the defined position thereof, the horizontal LD line of the overall light distribution (LV) is formed by the horizontal LD line (HD1) of the at least one reflector (1) of the asymmetric reflector type and/or by the horizontal LD line (HD2) of the least one reflector (2) of the LD front-field reflector type.

15 Claims, 4 Drawing Sheets

(56) References Cited

U.S. PATENT DOCUMENTS

Figure 1:
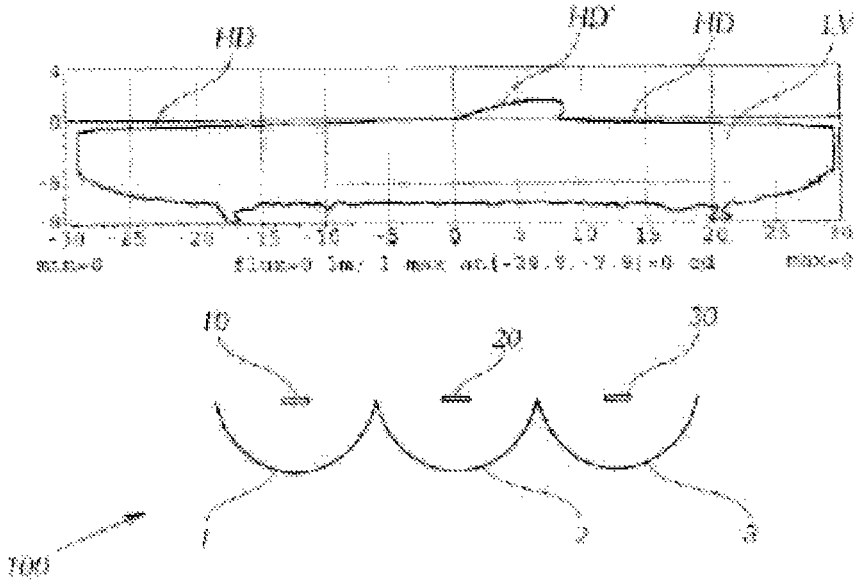

| | | | | |
|---|---|---|---|---|
| 2009/0097268 | A1* | 4/2009 | Mochizuki | F21S 48/1159 362/538 |
| 2009/0122567 | A1* | 5/2009 | Mochizuki | F21S 48/1159 362/509 |
| 2010/0277940 | A1* | 11/2010 | Ishida | F21S 48/1159 362/538 |
| 2012/0262935 | A1* | 10/2012 | Yamamoto | B60Q 1/14 362/516 |

* cited by examiner

LIGHT MODULE FOR A VEHICLE HEADLAMP

The invention relates to a light module for a motor vehicle or for a motor vehicle headlight, wherein the light module is configured to generate a dimmed light distribution having at least one horizontal LD line and an LD line ascending diagonally with respect thereto, and wherein the light module comprises at least two reflectors, and wherein each reflector is associated with at least one LED light source, wherein at least one of the reflectors is of the LD front-field reflector type, this type being designed to project light of the at least one LED light source associated therewith as front-field light distribution with an LD line running substantially horizontally in the light pattern, and wherein at least one further reflector is of the asymmetric reflector type, this type being designed to project light of the at least one LED light source associated therewith as asymmetric light distribution, wherein the asymmetric light distribution has an LD line running substantially horizontally and an LD line ascending diagonally.

The invention also relates to a vehicle headlight comprising at least one above-mentioned light module.

On account of the on-going reduction of reflector systems, the tolerance demands on the positioning accuracy of the light sources in relation to the reflector and on that of the individual reflectors relative to one another, and the demands on the shape accuracy of the individual reflectors are becoming increasingly greater. This is true in particular when an overall light distribution, for example a dimmed light distribution, in particular a dipped light distribution, with a defined light/dark transition (LD line), is formed from two or more light distributions, which are generated by means of two or more reflectors. Here, each reflector is associated with at least one light source, wherein the above-mentioned problem in particular then comes to light when the light sources are LED light sources. Here, each reflector is associated with at least one LED light source, wherein each LED light source has one or more light-emitting diodes (LEDs).

Currently, corresponding light modules are constructed in such a way that the reflectors are adjustable with respect to the LED light sources, which are positioned on an LED circuit board.

The reflectors are then adjusted in a system designed especially for this purpose, which senses the light distributions generated by means of the individual reflectors and positions the reflectors in such a way that the light/dark transitions of the individual light distribution are oriented relative to one another in such a way that a legally compliant overall light distribution is provided.

An extremely exact orientation of the reflectors is of particular significance here, since even a minor deviation of the relative position of reflector and LED light source relative to one another by, for example, 0.1 mm-0.2 mm in typical light module designs leads to a (vertical/horizontal) displacement of the light distribution and to a defocusing and blurring of the light/dark boundary.

The above-described method for the orientation of reflectors with respect to LED light sources is costly and complex and is therefore suitable for current high-end vehicle headlights. For more economical vehicles, however, the use of such a costly and complex method is not competitive with conventional halogen vehicle headlights currently used.

The object of the invention is to create a light module with which a legally compliant light distribution with a light/dark boundary can be generated by means of two or more reflectors in a substantially simpler and more economical manner.

This object is achieved with a light module mentioned in the introduction in that, in accordance with the invention, the at least one LED light source associated with the least one reflector of the asymmetric reflector type and the at least one LED light source associated with the at least one reflector of the LD front-field reflector type are arranged in a manner fixed relative to one another, all reflectors can be arranged in exactly one defined position with respect to the LED light sources associated therewith, and wherein reflectors of the asymmetric reflector type and reflectors of the LD front-field reflector type are configured in such a way that, with arrangement of at least one reflector of the asymmetric reflector type in the defined position thereof and with arrangement of at least one reflector of the LD front-field reflector type in the defined position thereof, the horizontal LD line of the overall light distribution is formed by the horizontal LD line of the at least one reflector of the asymmetric reflector type and/or by the horizontal LD line of the least one reflector of the LD front-field reflector type.

Accordingly, in accordance with the invention, the reflectors cannot be adjusted with respect to the LED light sources thereof, but instead a fixed position is provided, in which the reflectors are secured. Complex adjustment procedures can thus be avoided, and the costs can be lowered accordingly.

In accordance with the invention, in order to nevertheless be able to attain a satisfactory light pattern with a legally compliant light/dark boundary of the overall light distribution, the reflectors, which are calculated and manufactured in accordance with the defined position with respect to the associated LED light sources, are embodied in such a way that the LD line of the overall light distribution is generated either by one of the two different reflector types (asymmetric, LD front-field) or jointly by both. Here it is optimal, when the LD line is generated by the at least one asymmetric reflector, but if the LD line thereof lies too deep in the light pattern, this can be formed by the LD front-field reflector.

In accordance with an advantageous embodiment of the invention at least two reflectors are provided for the generation of the front-field light distribution: at least one reflector of the LD front-field reflector type and at least one reflector of the close front-field reflector type.

The at least one reflector of the LD front-field reflector type here generates the upper part of the front-field light distribution with the upper delimitation of the front-field light distribution with the horizontal delimitation line, whereas the at least one reflector of the close front-field reflector type forms the portion of the front-field light distribution arranged therebelow. The two partial light distributions overlap. The horizontal delimitation line or LD line forms the LD line of this front-field light distribution, but is not to be identified in the overall light distribution as a light/dark boundary, since it lies within the other partial light distributions.

Terms such as "above", "below", "vertical" and "horizontal" in conjunction with a light pattern do not relate here to the light pattern actually projected onto a carriageway located in front of a vehicle, but to the light pattern projected onto a vertical screen at a defined distance (for example 10 or 25 meters).

Furthermore, each system consisting of at least one reflector of a certain type and associated at least one LED light source is subject to a preferably adjustable tolerance, such that horizontal LD lines in the light patterns generated by reflectors of the same type and associated at least one LED light source lie within a vertical tolerance field, wherein the tolerance field of each reflector type in each case has an upper tolerance field boundary and a lower tolerance field boundary.

When reference is made hereinafter in conjunction with tolerance (tolerance field) to a reflector or reflector type, this thus means the tolerance or the tolerance field of the reflector/light source system. For the sake of simplicity, however, reference will be made mostly merely to the tolerance or tolerance field of the reflector.

This "tolerance of a reflector type" or this "tolerance field of a reflector type" results from the fact that reflectors of a certain type are subject to a tolerance, the associated at least one LED light source itself is subject to a tolerance, the position of the at least one LED light source is subject to a tolerance, and also the position of the reflectors is subject to a tolerance.

The term tolerance field then means the following: under abstract consideration of a light unit for generating a light distribution with a horizontal light/dark boundary, the light unit has a defined light source, which is positioned on a carrier plate at a defined point. The carrier plate or the light unit has a defined position for the reflector.

With a first light unit of this type, the light/dark boundary will assume a certain vertical position. With a second light unit constructed with identical component parts, the light/dark boundary will have a different vertical position, etc. (with regard to the term "vertical" see also the explanations further below).

Under consideration of a large number of light units, the position of the light/dark boundary will thus cluster around a certain position, and the number of the light/dark boundaries upwardly and downwardly will reduce.

The vertical region within which the generated light/ dark boundary lies is referred to as the tolerance field. The "height" of the tolerance field, i.e. the vertical extent, can be adjusted primarily by the accuracy of the manufacture of the reflectors.

A defined region, i.e. a defined upper and lower boundary and therefore also a defined height for the tolerance field of a certain reflector type, is usually predefined. Reflectors that do not meet these conditions, which thus generate a light/dark boundary lying outside the tolerance field, are not used in the series production.

In the present invention a light module is constructed from two or more such light units. Since the LED light sources of all light units sit on a common carrier plate or at least are arranged in a manner fixed relative to one another, and the positions of the associated reflectors are also fixed, an adjustment of the tolerance fields can still be made only via the embodiment of the reflectors. Reference is therefore no longer made subsequently to light units, but to different types of reflectors and the tolerance fields associated with these types of reflectors.

In accordance with a first embodiment of the invention the at least one reflector of the LD front-field reflector type and also the at least one reflector of the asymmetric reflector type are configured in such a way that, in the defined positions thereof with respect to the associated LED light sources, the tolerance fields of the reflectors of the LD front-field reflector type and of the asymmetric reflector type do not overlap one another in the vertical direction, and therefore the tolerance field lower boundary of the at least one asymmetric reflector lies above or at the same height as the tolerance field upper boundary of the at least one reflector of the LD front-field reflector type.

With this embodiment the horizontal light/dark boundary of the overall light distribution of the dimmed light distribution can be generated by at least one reflector of the asymmetric reflector type, as is desirable in principle.

However, with the above-mentioned embodiment there may be the effect, with a not insignificant number of light modules, that vertical light/dark stripes appear below the uppermost LD line, which is undesirable.

In order to avoid this, in accordance with another variant, the at least one reflector of the LD front-field reflector type and also the at least one reflector of the asymmetric reflector type are configured in such a way that, in the defined positions thereof with respect to the associated LED light sources, the tolerance fields of the reflectors of the LD front-field reflector type and of the asymmetric reflector type overlap one another in the vertical direction in such a way that the tolerance field lower boundary of the at least one asymmetric reflector lies below the tolerance field upper boundary of the at least one reflector of the LD front-field reflector type, and the tolerance field upper boundary of the at least one reflector of the asymmetric reflector type lies above the tolerance field upper boundary of the at least one reflector of the LD front-field reflector type.

As a result of this "closing together" and overlapping of the tolerance fields, it is accepted that in certain cases the light/dark boundary of the overall light distribution is generated by an LD front-field reflector, however such a light pattern is better than that with vertical light/dark stripes, and such a light module can be used generally without difficulty.

Furthermore, the at least one reflector of the close front-field reflector type is advantageously configured in such a way that, in the defined position thereof with respect to the at least one LED light source associated therewith, the tolerance field upper boundary of the tolerance field of the at least one reflector of the close front-field reflector type lies below the tolerance field lower boundary of the at least one reflector of the asymmetric reflector type.

In this way the light/dark boundary of a close front-field reflector, which generally does not have the required sharpness, gradient, etc. for an LD line of a dimmed light distribution, is reliably prevented from contributing to the LD line of the overall light distribution.

It is also noted that the wording "the tolerance field of the at least one reflector of type X" does not mean that each reflector of type X has its own tolerance field, but that the reflector is configured in such a way that the LD line thereof lies within the tolerance field of the reflectors of type X.

In addition the at least one reflector of the close front-field reflector type is advantageously configured in such a way that the tolerance field upper boundary of the at least one reflector of the close front-field reflector type lies below the tolerance field upper boundary of the at least one reflector of the LD front-field reflector type and above the tolerance field lower boundary of the at least one reflector of the LD front-field reflector type.

An overlap of the front-field light distributions and thus a homogeneous light distribution is additionally achieved as a result.

So that the desired position of the LD line can be reliably provided within reliable boundaries, the at least one reflector of the asymmetric reflector type is also advantageously configured in such a way that the horizontal LD line of the overall light distribution lies within the tolerance field of the at least one reflector of the asymmetric reflector type.

In addition, the tolerance fields of the at least one reflector of the asymmetric reflector type and the tolerance field of the at least one reflector of the LD front-field reflector type preferably overlap one another in the vertical direction by 0.1° -0.2° .

The overlap region between the tolerance field upper boundary of the LD front-field light distribution and the tolerance field lower boundary of the asymmetric light distribution thus extends over a range from 0.1° -0.2° in the vertical direction.

In accordance with a specific embodiment each LED light source comprises at least one light-emitting diode.

As already mentioned further above, the LED light sources associated with the at least one reflector of the asymmetric reflector type and with the at least one reflector of the LD front-field reflector type are preferably additionally arranged on a common carrier plate, preferably a common LED circuit board.

The at least one LED light source associated with the at least one reflector of the close front-field reflector type is advantageously also likewise positioned on the common carrier plate, preferably on the common LED circuit board.

So as to be able to ensure an identical position of the individual reflectors from light module to light module (within the tolerances), securing means and/or positioning means are additionally provided, by means of which reflectors of the same type can be positioned and secured on different carrier plates in the same position with respect to the LED light sources of the carrier plate.

The frequency distribution of the positions of the horizontal LD lines within the tolerance fields of the reflectors typically follow a distribution curve, for example a Gaussian distribution curve, wherein the distribution curves each have a distribution maximum.

In order to obtain the greatest possible number of light modules of which the light pattern is legally compliant, the distribution maximum of the tolerance field of the at least one reflector of the asymmetric reflector type lies, in its defined positions with respect to the associated LED light sources, above the distribution maximum of the tolerance field of the at least one reflector of the LD front-field reflector type.

Furthermore, in this context, the distribution maximum of the tolerance field of the at least one reflector of the asymmetric reflector type lies above the tolerance field upper boundary of the tolerance field of the at least one reflector of the LD front-field reflector type.

Lastly, the distribution maximum of the tolerance field of the at least one reflector of the LD front-field reflector type also lies below the tolerance field lower boundary of the tolerance field of the at least one reflector of the asymmetric reflector type.

Figure 2:
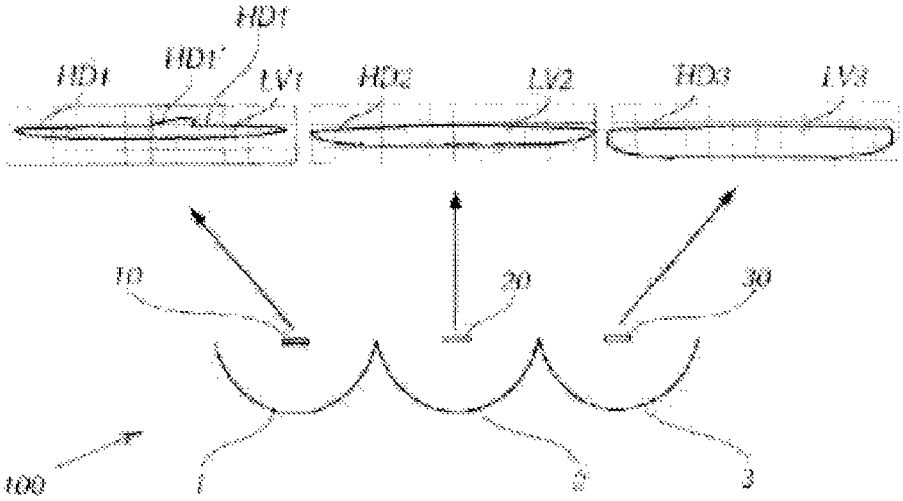
Figure 3:
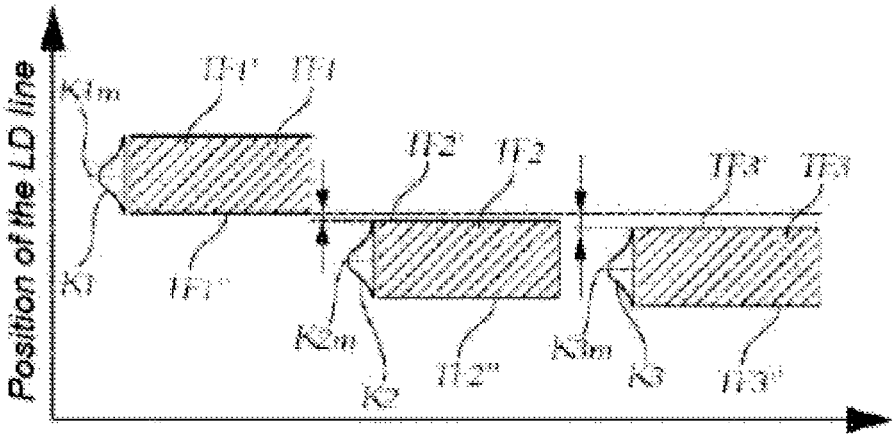
Figure 4:
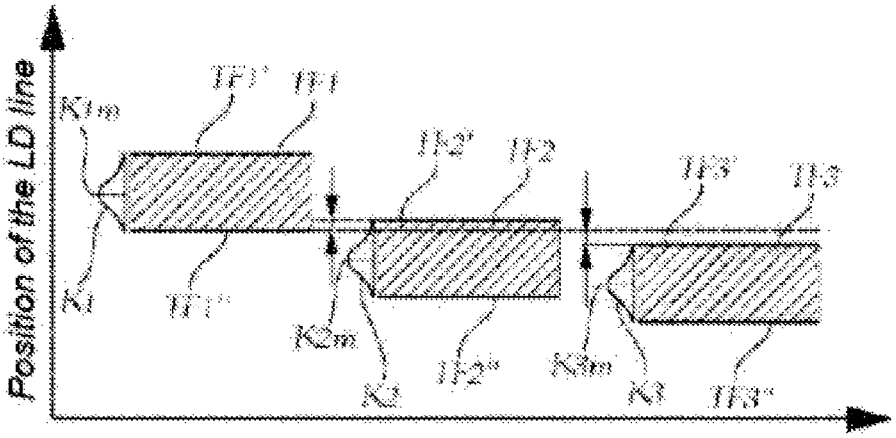
Figure 5:
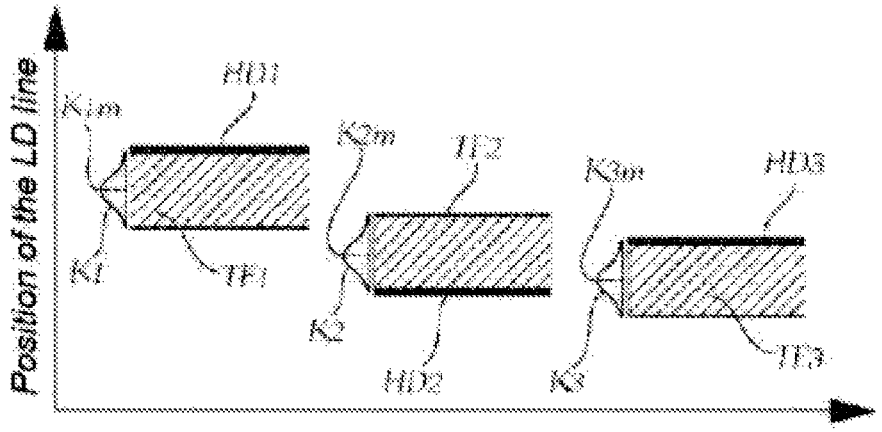
Figure 6:
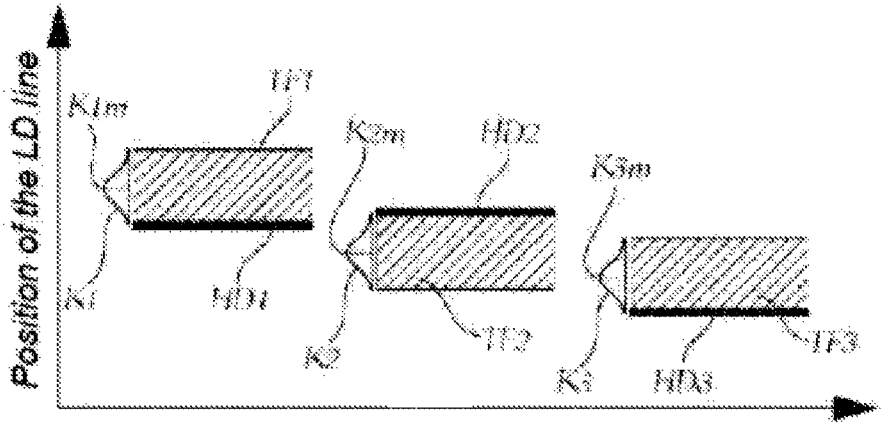
Figure 7:
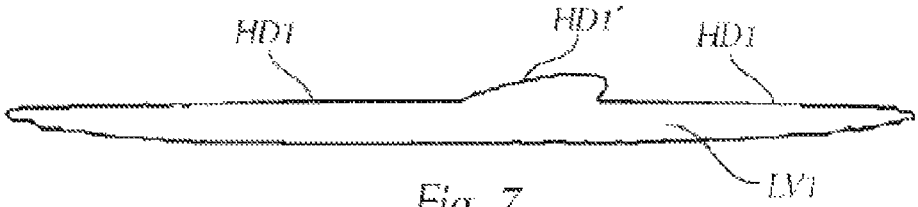
Figure 8:
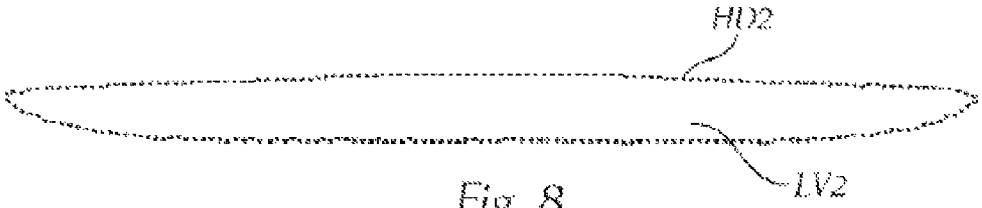
Figure 9:
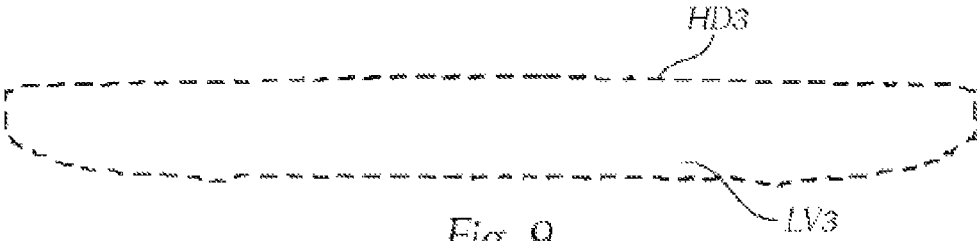
Figure 10:
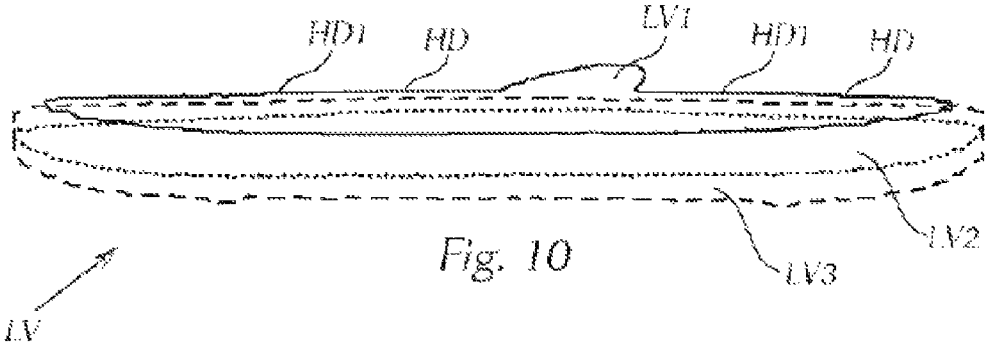

The invention will be explained in greater detail hereinafter on the basis of the drawing, in which FIG. 1 shows a dipped light distribution generated with three different reflectors, FIG. 2 shows the dipped light distribution from FIG. 1, divided into the three partial light distributions thereof, FIG. 3 shows a first position according to the invention of the tolerance fields of the three reflectors, FIG. 4 shows a further position according to the invention of the tolerance fields of the three reflectors, FIG. 5 shows a first exemplary position of the light/dark boundaries with a position of the tolerance fields as shown in FIG. 4, FIG. 6 shows a further exemplary position of the light/dark boundaries with a position of the tolerance fields as shown in FIG. 4, FIG. 7 shows an asymmetric light distribution, FIG. 8 shows an LD front-field light distribution, FIG. 9 shows a close front-field light distribution, FIG. 10 shows a superimposition of the light distributions from FIGS. 7-9, and FIG. 11 shows a further possible superimposition of the light distributions from FIGS. 7-9.

FIG. 1 shows a light module 100 for a motor vehicle or for a motor vehicle headlight, wherein the light module 100 is configured to generate a dipped light distribution LV, as illustrated schematically in FIG. 1. Such a dipped light distribution LV, as is known, has a horizontal LD line HD and an LD line HD' ascending diagonally with respect thereto.

In the shown embodiment the light module 100 comprises three reflectors 1, 2, 3, wherein each reflector 1, 2, 3 is associated with an LED light source 10, 20, 30. Each LED light source 10, 20, 30 comprises one or more light-emitting diodes.

The light of the LED light sources 10, 20, 30 is projected via the associated reflectors 1, 2, 3 in each case as a partial light distribution into a region in front of the vehicle, the superimposition of the partial light distribution giving the overall light distribution of a headlight or a light module of a headlight.

The first reflector 1 is a reflector of the asymmetric reflector type, which type is designed to project light of the LED light source 10 associated therewith as an asymmetric light distribution LV1, wherein the asymmetric light distribution LV1 has a substantially horizontally running LD line HD1 and a diagonally ascending LD line HD1'.

Such an asymmetric light distribution LV1 is illustrated in FIG. 2 and again in detail in FIG. 7.

The second reflector 2 is a reflector of the LD front-field reflector type, which type is designed to project light of the LED light source 20 associated therewith as front-field light distribution LV2 with an LD line HD2 running substantially horizontally in the light pattern.

Such a front-field light distribution LV2 is illustrated in FIG. 2 and again in detail in FIG. 8.

The third reflector 3 is a reflector of the close front-field reflector type, which type is designed to project light of the LED light source 30 associated therewith as close front-field light distribution LV3 with an LD line HD3 running substantially horizontally in the light pattern.

Such a close front-field light distribution LV3 is illustrated in FIG. 2 and again in detail in FIG. 9.

In order to generate the front-field light distribution, two reflectors 2, 3 are thus provided, wherein the reflector 2 of the LD front-field reflector type generates the upper part of the front-field light distribution LV2 with the upper boundary of the front-field light distribution with the horizontal boundary line HD2, and the further reflector 3 of the close front-field reflector type generates the portion of the front-field light distribution lying therebelow. The two partial light distributions LV2, LV3 overlap. The horizontal boundary line or LD line HD3 forms the HD line of this front-field light distribution, but in the overall light distribution cannot be identified as a light/dark boundary, since it lies within the other partial light distributions.

Terms such as "above", "below", "vertical" and "horizontal" in conjunction with a light pattern do not relate here to the light pattern actually projected onto a carriageway lying in front of a vehicle, but to the light pattern projected onto a vertical screen at a defined distance (for example 10 or 25 meters).

Furthermore, on the one hand the reflectors 1, 2, 3 are each positioned in a manner fixed with respect to their LED light sources 10, 20, 30, and on the other hand the individual systems consisting in each case of reflector and associated light source are positioned in a fixed manner or can be mounted only in a precisely predefined position with respect to one another. In other words this means that, with a light module of a specific type, there are no possibilities for adjustment of the reflectors with respect to the light sources and of the reflectors relative to one another, such that, within the respective tolerances, the arrangements are quasi congruent, within the respective tolerances. Complex adjustment procedures can thus be avoided, and the costs can be lowered accordingly.

In order to nevertheless attain a satisfactory light pattern with a legally compliant light/dark boundary of the overall light distribution with a sufficiently large number of produced light modules, the following approach as described hereinafter is adopted in accordance with the invention, described with reference to a preferred embodiment of the invention:

In principle, each system consisting of at least one reflector 1, 2, 3 of a certain type and associated LED light source 10, 20, 30 is subject to a tolerance, which is given from the tolerances of the reflector, those of the LED light source and also the tolerances resulting from the positioning of reflector and LED light source relative to one another.

This tolerance is adjustable in principle and can usually still be influenced via the manufacturing accuracy of the reflectors, since the LED light sources often are delivered already pre-assembled on a printed circuit board and the positions of the reflectors with respect to the printed circuit boards can also already be predefined.

These tolerances here generally have little influence on the actual form of the partial light distribution generated in each case, but rather influence the position and also the embodiment of the light/dark boundary or the upper boundary of the partial light distribution, or the tolerances have a particularly strong effect on the light/dark boundary.

At given tolerances the horizontal LD lines HD1, HD2, HD3 of the partial light patterns LV1, LV2, LV3 generated with reflectors 1, 2, 3 of a certain type and associated LED light source 10, 20, 30 therefore lie within vertical tolerance fields TF1, TF2, TF3. Such tolerance fields TF1, TF2, TF3 are shown in FIG. 3 and FIG. 4.

The tolerance field TF1, TF2, TF3 of any reflector type here in each case has an upper tolerance field boundary TF1', TF2', TF3' and a lower tolerance field boundary TF1", TF2", TF3". When, here, reference is made in conjunction with the term "tolerance" or "tolerance field" to a reflector or reflector type, the tolerance or the tolerance field of the reflector/light source system is thus intended. For the sake of simplicity, however, reference is usually made merely to the tolerance or tolerance field of the reflector.

This "tolerance of a reflector type" or this "tolerance field of a reflector type" is given from the fact that reflectors of a certain type are subject to a tolerance, the associated at least one LED light source itself is subject to a tolerance, the position of the at least one LED light source is subject to a tolerance, and also the position of the reflectors is subject to a tolerance, as has already been mentioned above.

The term tolerance field then means the following: the system consisting of reflector 1 and LED light source 10, which generates a light distribution LV1 with a horizontal light/dark boundary HD1, is considered, for example. This system has a defined light source 10, which is positioned on a carrier plate at a defined point. The system also has a defined position for the reflector 1.

In a first system of this type the light/dark boundary HD1 will assume a certain vertical position. In a second light unit constructed with identical component parts the light/dark boundary will have another vertical position, etc.

Under consideration of a large number of light units, the position of the light/dark boundary will thus cluster around a certain position, and the number of the light/dark boundaries will reduce upwardly and downwardly.

The vertical region within which the generated light/dark boundary may lie is referred to as the tolerance field TF1. Light units with an LD line lying outside the tolerance field cannot be used.

These considerations apply similarly also for reflector 2 and LED light source 20, and also reflector 3 and LED light source 30.

The frequency distribution of the position of the horizontal LD lines HD1, HD2, HD3 within the tolerance fields TF1, TF2, TF3 of the different reflector types 1, 2, 3 here follows a distribution curve K1, K2, K3 as shown in FIG. 3 and FIG. 4, for example a Gaussian distribution curve, wherein the distribution curves K1, K2, K3 each have a distribution maximum K1*m*, K2*m*, K3*m*.

In accordance with a first embodiment of the invention as shown in FIG. 3 the reflector 2 of the LD front-field reflector type and also the reflector 1 of the asymmetric reflector type are formed in such a way that, in the defined positions thereof with respect to the associated LED light sources 10, 20, the tolerance fields TF1, TF2 of the reflectors 1, 2 of the LD front-field reflector type and of the asymmetric reflector type do not overlap one another in the vertical direction, and therefore the tolerance field lower boundary TF1" of the asymmetric reflector 1 lies above or at the same height as the tolerance field upper boundary TF2' of the reflector 2 of the LD front-field reflector type.

With this embodiment the horizontal light/dark boundary of the overall light distribution of the dimmed light distribution can be generated by at least one reflector of the asymmetric reflector type, as is desirable in principle.

However, with this embodiment there may be the effect, with a not insignificant number of light modules, that vertical light/dark stripes appear below the uppermost LD line, which is undesirable.

In order to avoid this, in accordance with another variant according to FIG. 4, the reflector 2 of the LD front-field reflector type and also the reflector 1 of the asymmetric reflector type are configured in such a way that, in the defined positions thereof with respect to the associated LED light sources 10, 20, the tolerance fields TF1, TF2 of the reflectors 1, 2 of the LD front-field reflector type and of the asymmetric reflector type overlap one another in the vertical direction in such a way that the tolerance field lower boundary TF1" of the asymmetric reflector 1 lies below the tolerance field upper boundary TF2' of the reflector 2 of the LD front-field reflector type, and the tolerance field upper boundary TF1' of the reflector 1 of the asymmetric reflector type 1 lies above the tolerance field upper boundary TF2' of the reflector 2 of the LD front-field reflector type.

As a result of this "closing together" and overlapping of the tolerance fields TF1, TF2, it is accepted that in certain cases the light/dark boundary of the overall light distribution is generated by an LD front-field reflector 2, however such a light pattern is better than that with vertical light/dark stripes, and such a light module can be used generally without difficulty.

Both in the embodiment according to FIG. 3 and in that according to FIG. 4, the reflector 3 of the close front-field reflector type is configured such that, in its defined position with respect to the at least one LED light source 30 associated therewith, the tolerance field upper boundary TF3' of the tolerance field TF3 of the reflector 3 of the close front-field reflector type lies below the tolerance field lower boundary TF1" of the reflector 1 of the asymmetric reflector type.

In this way the light/dark boundary HD3 of a close front-field reflector 3, which generally does not have the required sharpness, gradient, etc. for an LD line of a dimmed light distribution, is reliably prevented from contributing to the LD line of the overall light distribution.

It is also noted that the wording "the tolerance field of the at least one reflector of type X" does not mean that each reflector of type X has its own tolerance field, but that the reflector is configured in such a way that the LD line thereof lies within the tolerance field of the reflectors of type X.

In addition the reflector 3 of the close front-field reflector type is advantageously configured in such a way that the tolerance field upper boundary TF3' of the reflector 3 of the close front-field reflector type lies below the tolerance field upper boundary TF2' of the reflector 2 of the LD front-field reflector type and above the tolerance field lower boundary TF2" of the reflector 2 of the LD front-field reflector type.

An overlap of the front-field light distributions LV2, LV3 and thus a homogeneous light distribution is additionally achieved as a result.

So that the desired position of the LD line can be reliably provided within reliable boundaries, the reflector 1 of the asymmetric reflector type is also advantageously configured in such a way that the (desired or stipulated) position of the horizontal LD line HD of the overall light distribution LV lies within the tolerance field TF1 of the reflector 1 of the asymmetric reflector type.

In addition, in an embodiment of the invention according to FIG. 4, the tolerance field TF1 of the reflector 1 of the asymmetric reflector type and the tolerance field TF2 of the reflector 2 of the LD front-field reflector type preferably overlap one another in the vertical direction by 0.1° -0.2° .

The overlap region between the tolerance field upper boundary TF2' of the LD front-field light distribution LV2 and the tolerance field lower boundary TF1" of the asymmetric light distribution LV1 thus extends over a range from 0.1° -0.2° in the vertical direction.

As can also be deduced from FIG. 3 and FIG. 4, in order to obtain the greatest possible number of light modules of which the light pattern is legally compliant, the distribution maximum K1*m* of the tolerance field TF1 of the reflector 1 of the asymmetric reflector type preferably lies, in its defined positions with respect to the associated LED light sources 10, 20, above the distribution maximum K2*m* of the tolerance field TF2 of the reflector 2 of the LD front-field reflector type.

Furthermore, in this context, the distribution maximum K1*m* of the tolerance field TF1 of the reflector 1 of the asymmetric reflector type lies above the tolerance field upper boundary TF2' of the tolerance field TF2 of the reflector 2 of the LD front-field reflector type.

Lastly, the distribution maximum K2*m* of the tolerance field TF2 of the reflector 2 of the LD front-field reflector type also lies below the tolerance field lower boundary TF1" of the tolerance field TF1 of the reflector 1 of the asymmetric reflector type.

Proceeding from FIG. 4, FIGS. 5 and 6 show two extreme situations that may occur with an assembly of a light module according to the invention.

With a light module according to FIG. 5, the light/dark boundary HD1 generated by the reflector 1 lies in the uppermost region of the tolerance field TF1 of the reflectors of the asymmetric reflector type. Irrespective of where specifically within the tolerance field TF2 of the HD front-field reflectors the light/dark boundary HD2 of the reflector 2 lies, the horizontal light/dark line HD of the dipped light distribution is generated in this case by the reflector 1.

Furthermore, in the shown example according to FIG. 5, the light/dark boundary HD2 lies at the lowermost boundary of the tolerance field TF2, whereas the LD line HD3 of the reflector 3 lies at the uppermost boundary of the tolerance field TF3 and thus above the LD line HD2.

With a light module corresponding to FIG. 6 the light/dark boundary HD1 generated by the reflector 1 lies in the lowermost region of the tolerance field TF1 of the reflectors of the asymmetric reflector type. The light/dark boundary HD2, which is generated by the reflector 2, also lies here in the uppermost region of the tolerance field TF2 of the LD front-field reflectors and thus above the light/dark boundary HD1. In this example the horizontal light/dark line LD of the dipped light distribution is thus generated by the reflector 2.

The asymmetric portion HD' of the dipped light distribution LV is generated in any case by the reflector 1.

Referring again to FIGS. 7-9, these show, in order, the fundamental shaping of the asymmetric light distribution LV1 (FIG. 7), of the LD front-field light distribution (FIG. 8), and of the close front-field light distribution (FIG. 9).

FIG. 10 now shows a superimposition of the light distributions LV1, LV2, LV3 with the positions of the light/dark boundaries HD1, HD2, HD3 as illustrated in FIG. 5. As can be clearly seen, here the light/dark boundary HD of the overall light distribution LV is formed by the reflector 1.

Figure 11:
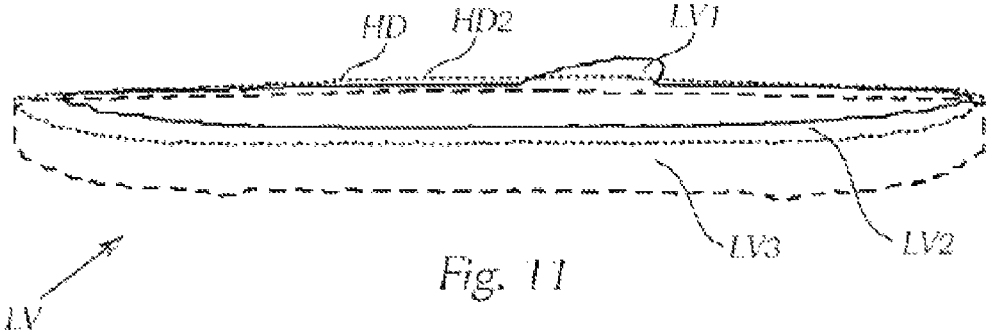

FIG. 11 lastly shows a superimposition of the light distributions LV1, LV2, LV3 in accordance with FIG. 6; here the light/dark boundary HD of the overall light distribution LV is formed by the reflector 2.

Lastly, it should be noted that, in the figures, exactly one reflector is used in each case to generate the light distributions LV1, LV2, LV3. However, it is also possible that two, three or more reflectors (in each case of the same type for a certain light distribution) are used for one, more or all light distributions. In this case, each reflector has at least one light source associated therewith. All used reflectors must each meet the conditions described above with reference to the example of in each case one reflector per partial light distribution.

It is also possible to generate the front-field light distribution only with a single reflector type, wherein, here again, precisely one or also two or more reflectors of this type can be used. Better results are generally attained, however, when the front-field light distribution is generated by means of at least two reflectors 2, 3 of different type, as described above.

The invention claimed is:

1. A light module for a motor vehicle or for a motor vehicle headlight, wherein the light module is configured to generate a dimmed light distribution (LV) which has at least one horizontal LD line (HD) and an LD line (HD') ascending diagonally with respect thereto, the light module comprising:

at least two reflectors, wherein each reflector is associated with at least one LED light source, wherein at least one of the reflectors is an LD front-field reflector type which is designed to project light of the at least one LED light source associated therewith as a front-field light distribution (LV2) with an LD line (HD2) running substantially horizontally in the light pattern, and wherein at least one other reflector is an asymmetric reflector type which is designed to project light of the at least one LED light source associated therewith as an asymmetric light distribution (LV1), wherein the asymmetric light distribution (LV1) has an LD line (HD1) running substantially horizontally and an LD line (HD1') ascending diagonally, wherein the at least one LED light source associated with the least one reflector of the asymmetric reflector type and the at least one LED light source associated with the at least one reflector of the LD front-field reflector type are arranged in a manner fixed relative to one another, the reflectors being arranged in exactly one defined position with respect to the LED light sources associated therewith, wherein the reflectors of the asymmetric reflector type and the reflectors of the LD front-field reflector type are configured in such a way that, with arrangement of the at least one reflector of the asymmetric reflector type in the defined position thereof and with arrangement of the at least one reflector of the LD front-field reflector type in the defined position thereof, the horizontal LD line of the overall light distribution (LV) is formed by the horizontal LD line (HD1) of the at least one reflector of the asymmetric reflector type and/or by the horizontal LD line (HD2) of the least one reflector of the LD front-field reflector type, wherein each system consisting of the reflector of a certain type and the associated at least one LED light source is subject to a tolerance, such that horizontal LD lines in the light patterns (LV1, LV2, LV3) generated by the reflectors of the same type and the associated at least one LED light source lie within a vertical tolerance field (TF1, TF2, TF3), wherein the tolerance field (TF1, TF2, TF3) of each reflector type in each case has an upper tolerance field boundary (TF1', TF2', TF3') and a lower tolerance field boundary (TF1", TF2", TF3"), the at least one reflector of the LD front-field reflector type and the at least one reflector of the asymmetric reflector type are configured in such a way that, in the defined positions thereof with respect to the associated LED light sources, the tolerance fields (TF1, TF2) of the reflectors of the LD front-field reflector type and of the asymmetric reflector type overlap one another in the vertical direction in such a way that the tolerance field lower boundary (TF1") of the at least one asymmetric reflector lies below the tolerance field upper boundary (TF2') of the at least one reflector of the LD front-field reflector type, and the tolerance field upper boundary (TF1') of the at least one reflector of the asymmetric reflector type lies above the tolerance field upper boundary (TF2') of the at least one reflector of the LD front-field reflector type, and the frequency distribution of the position of the horizontal LD lines (HD1, HD2, HD3) within the tolerance fields (TF1, TF2, TF3) of the reflectors follow a distribution curve (K1, K2, K3), for example a Gaussian distribution curve, wherein the distribution curves (K1, K2, K3) each have a distribution maximum (K1*m*, K2*m*, K3*m*), and wherein:

the distribution maximum (K1*m*) of the tolerance field (TF1) of the at least one reflector of the asymmetric reflector type lies above the tolerance field upper boundary (TF2') of the tolerance field (TF2) of the at least one reflector of the LD front-field reflector type, and/or the distribution maximum (K2*m*) of the tolerance field (TF2) of the at least one reflector of the LD front-field reflector type lies below the tolerance field lower boundary (TF1") of the tolerance field (TF1) of the at least one reflector of the asymmetric reflector type.

2. The light module of claim 1, wherein at least two reflectors are provided for the generation of the front-field light distribution, at least one reflector being of the LD front-field reflector type and at least one reflector being of the close front-field reflector type.

3. The light module of claim 2, wherein the at least one reflector of the close front-field reflector type is configured in such a way that, in its defined position with respect to the at least one LED light source associated therewith, the tolerance field upper boundary (TF3') of the tolerance field (TF3) of the at least one reflector of the close front-field reflector type lies below the tolerance field lower boundary (TF1") of the at least one reflector of the asymmetric reflector type.

4. The light module of claim 3, wherein the at least one reflector of the close front-field reflector type is configured in such a way that the tolerance field upper boundary (TF3') of the at least one reflector of the close front-field reflector type lies below the tolerance field upper boundary (TF2') of the at least one reflector of the LD front-field reflector type and above the tolerance field lower boundary (TF2") of the at least one reflector of the LD front-field reflector type.

5. The light module of claim 1, wherein the at least one reflector of the asymmetric reflector type is configured in such a way that the horizontal LD line (HD) of the overall light distribution (LV) lies within the tolerance field (TF1) of the at least one reflector of the asymmetric reflector type.

6. The light module of claim 1, wherein the tolerance fields (TF1) of the at least one reflector of the asymmetric reflector type and the tolerance field (TF2) of the at least one reflector of the LD front-field reflector type overlap one another in the vertical direction by 0.1°-0.2° .

7. The light module of claim 1, wherein each LED light source comprises at least one light-emitting diode (LED).

8. The light module of claim 1, wherein the LED light sources associated with the at least one reflector of the asymmetric reflector type and associated with the at least one reflector of the LD front-field reflector type are arranged on a common carrier plate.

9. The light module of claim 8, wherein the common carrier plate comprises an LED circuit board.

10. The light module of claim 8, wherein the at least one LED light source associated with the at least one reflector of the close front-field reflector type is likewise positioned on the common carrier plate.

11. The light module of claim 1, wherein securing means and/or positioning means are provided, by means of which reflectors of the same type can be positioned and secured on different carrier plates in the same position with respect to the LED light sources of the carrier plate.

12. The light module of claim 1, wherein the distribution maximum (K1*m*) of the tolerance field (TF1) of the at least one reflector of the asymmetric reflector type lies, in its defined positions with respect to the associated LED light sources, above the distribution maximum (K2*m*) of the tolerance field (TF2) of the at least one reflector of the LD front-field reflector type.

13. A vehicle headlight comprising at least one light module of claim 1.

14. The light module of claim 1, wherein the tolerance to which each of the systems consisting of the reflector of a certain type and the associated at least one LED light source is adjustable.

15. The light module of claim 1, wherein the distribution curve (K1, K2, K3) is a Gaussian distribution curve.

* * * * *